US008483419B1

(12) United States Patent
Bauman

(10) Patent No.: US 8,483,419 B1
(45) **Date of Patent: *Jul. 9, 2013**

(54) OPEN EAR HEARING AID SYSTEM

(75) Inventor: Natan Bauman, Cheshire, CT (US)

(73) Assignee: Auditory Licensing Company, LLC, Westport, CT (US)

( * ) Notice: Subject to any disclaimer, the term of this patent is extended or adjusted under 35 U.S.C. 154(b) by 275 days.

This patent is subject to a terminal disclaimer.

(21) Appl. No.: 12/829,494

(22) Filed: Jul. 2, 2010

Related U.S. Application Data

(63) Continuation of application No. 12/170,574, filed on Jul. 10, 2008, and a continuation of application No. 11/331,842, filed on Jan. 13, 2006, now Pat. No. 7,421,086, and a continuation of application No. 10/773,731, filed on Feb. 5, 2004, now abandoned, and a continuation of application No. 10/325,529, filed on Dec. 18, 2002, now Pat. No. 7,751,580, and a continuation of application No. 10/241,279, filed on Sep. 10, 2002, now Pat. No. 7,076,076.

(60) Provisional application No. 60/445,034, filed on Feb. 5, 2003, provisional application No. 60/514,994, filed on Oct. 27, 2003, provisional application No. 60/535,569, filed on Jan. 9, 2004.

(51) Int. Cl.
*H04R 25/00* (2006.01)

(52) U.S. Cl.
USPC ..... 381/330; 381/322; 381/312

(58) Field of Classification Search
USPC ..... 381/23.1, 60, 72, 312, 317, 322, 381/324, 380, 382, 383; 181/129, 130, 131, 181/135
See application file for complete search history.

(56) References Cited

U.S. PATENT DOCUMENTS

| | | | |
|---|---|---|---|
| 789,876 | A | 5/1905 | Pape |
| 1,830,198 | A | 11/1931 | French |
| 2,363,175 | A | 11/1944 | Grossman |
| 2,930,856 | A | 3/1960 | Toht |
| 3,068,954 | A | 12/1962 | Strzalkowski |

(Continued)

FOREIGN PATENT DOCUMENTS

| | | |
|---|---|---|
| DE | 3502178 | 8/1985 |
| DE | 3508830 A1 | 9/1986 |

(Continued)

OTHER PUBLICATIONS

China Application No. 200480005563.4, Notification of Granting a Patent for Invention dated Dec. 29, 2011, with translated claims, 5 pages.

(Continued)

*Primary Examiner* — Brian Ensey
(74) *Attorney, Agent, or Firm* — Cantor Colburn LLP

(57) ABSTRACT

The present invention relates to a system for improving a user's hearing and more particularly to a receiver system used in the system. In one embodiment, the receiver system has a housing and a plurality of arms extending from the housing for positioning and suspending the receiver within the ear canal of a user. Each of the arms may be formed from a flexible, plastic material or a bendable wire. In a second embodiment, the receiver system is surrounded by a disc formed from a sound filtering material. When installed in a combination instrument, the receiver is separated from the microphone.

40 Claims, 3 Drawing Sheets

U.S. PATENT DOCUMENTS

| | | | | |
|---|---|---|---|---|
| 3,123,678 | A | 3/1964 | Prentiss et al. | |
| 3,209,082 | A | 9/1965 | McCarrell | |
| 3,581,570 | A | 6/1971 | Wortz | |
| 3,688,863 | A | 9/1972 | Johnson | |
| 3,764,748 | A | 10/1973 | Branch et al. | |
| 3,787,643 | A | 1/1974 | Nielsen | |
| 3,890,474 | A | 6/1975 | Glicksberg | |
| 3,934,100 | A | 1/1976 | Harada | |
| 4,089,332 | A | 5/1978 | Rose | |
| 4,222,393 | A | 9/1980 | Hocks et al. | |
| 4,226,248 | A | 10/1980 | Manoli | |
| 4,539,440 | A | 9/1985 | Sciarra | |
| 4,606,329 | A | 8/1986 | Hough | |
| 4,680,798 | A | 7/1987 | Neumann | |
| 4,727,582 | A | 2/1988 | de Vries et al. | |
| 4,735,968 | A | 4/1988 | Guth | |
| 4,759,070 | A | 7/1988 | Voroba et al. | |
| 4,830,139 | A | 5/1989 | Cirillo | |
| 4,870,688 | A | 9/1989 | Voroba et al. | |
| 4,954,486 | A | 9/1990 | Guth | |
| 4,956,391 | A | 9/1990 | Sapse | |
| 4,984,579 | A | 1/1991 | Burgert et al. | |
| 5,008,058 | A | 4/1991 | Henneberger et al. | |
| 5,024,612 | A | 6/1991 | van den Honert et al. | |
| 5,031,219 | A | 7/1991 | Ward et al. | |
| 5,064,858 | A | 11/1991 | Sapse | |
| 5,167,236 | A | 12/1992 | Junker | |
| 5,201,007 | A | 4/1993 | Ward et al. | |
| 5,279,292 | A | 1/1994 | Baumann et al. | |
| 5,325,782 | A | 7/1994 | Strauss et al. | |
| 5,328,330 | A | 7/1994 | Monroe | |
| 5,381,484 | A | 1/1995 | Claes et al. | |
| 5,403,262 | A | 4/1995 | Gooch | |
| 5,420,930 | A | 5/1995 | Shugart, III | |
| 5,430,801 | A | 7/1995 | Hill | |
| 5,563,140 | A | 10/1996 | Ehrenberger et al. | |
| 5,572,594 | A * | 11/1996 | Devoe et al. | 381/322 |
| 5,589,183 | A | 12/1996 | Jannetta | |
| 5,606,621 | A | 2/1997 | Reiter et al. | |
| 5,628,330 | A | 5/1997 | Upham | |
| 5,654,530 | A | 8/1997 | Sauer et al. | |
| 5,701,348 | A | 12/1997 | Shennib et al. | |
| 5,721,783 | A | 2/1998 | Anderson | |
| 5,757,935 | A | 5/1998 | Kang et al. | |
| 5,920,636 | A * | 7/1999 | Oliveira et al. | 181/130 |
| 5,960,093 | A | 9/1999 | Miller | |
| 5,979,589 | A | 11/1999 | Aceti | |
| 5,987,146 | A * | 11/1999 | Pluvinage et al. | 381/382 |
| 6,009,183 | A | 12/1999 | Taenzer et al. | |
| 6,021,207 | A | 2/2000 | Puthuff et al. | |
| 6,039,685 | A * | 3/2000 | Bushek | 381/322 |
| 6,048,305 | A | 4/2000 | Bauman et al. | |
| 6,094,492 | A | 7/2000 | Boesen | |
| 6,094,493 | A | 7/2000 | Borowsky et al. | |
| 6,101,259 | A | 8/2000 | Rapps | |
| 6,160,895 | A | 12/2000 | Dupont | |
| 6,181,801 | B1 * | 1/2001 | Puthuff et al. | 381/380 |
| 6,253,871 | B1 | 7/2001 | Aceti | |
| 6,275,596 | B1 | 8/2001 | Fretz et al. | |
| 6,320,969 | B1 | 11/2001 | Killion | |
| 6,359,993 | B2 | 3/2002 | Brimhall | |
| 6,367,578 | B1 | 4/2002 | Shoemaker | |
| 6,445,799 | B1 | 9/2002 | Taenzer et al. | |
| 6,453,051 | B1 | 9/2002 | Killion | |
| 6,473,513 | B1 | 10/2002 | Shennib et al. | |
| 6,493,453 | B1 | 12/2002 | Glendon | |
| 6,560,468 | B1 | 5/2003 | Boesen | |
| 6,600,825 | B1 | 7/2003 | Leysieffer | |
| 6,631,196 | B1 | 10/2003 | Taenzer et al. | |
| 6,704,423 | B2 | 3/2004 | Anderson et al. | |
| 6,724,902 | B1 | 4/2004 | Shennib et al. | |
| 6,748,094 | B1 | 6/2004 | Tziviskos et al. | |
| 6,804,368 | B2 | 10/2004 | Tsuda | |
| 6,914,994 | B1 | 7/2005 | Shennib et al. | |
| 7,027,608 | B2 | 4/2006 | Fretz et al. | |
| 7,068,803 | B2 * | 6/2006 | Kuhlmann et al. | 381/322 |
| 7,362,875 | B2 | 4/2008 | Saxton et al. | |
| 2002/0027996 | A1 | 3/2002 | Leedom et al. | |
| 2002/0085728 | A1 | 7/2002 | Shennib et al. | |
| 2002/0172386 | A1 | 11/2002 | Bayer | |
| 2002/0196958 | A1 | 12/2002 | Halteren et al. | |
| 2003/0002700 | A1 | 1/2003 | Fretz et al. | |
| 2003/0112992 | A1 | 6/2003 | Rapps | |
| 2004/0010181 | A1 | 1/2004 | Feeley et al. | |
| 2004/0047483 | A1 | 3/2004 | Bauman | |
| 2004/0258263 | A1 | 12/2004 | Saxton et al. | |
| 2005/0123146 | A1 | 6/2005 | Voix et al. | |

FOREIGN PATENT DOCUMENTS

| | | | |
|---|---|---|---|
| DE | 87001632 | | 4/1987 |
| DE | 3638747 | C1 | 10/1987 |
| DE | 3625891 | A1 | 2/1988 |
| DE | 29718483 | U1 | 10/1997 |
| DE | 29801567 | U1 | 5/1998 |
| EP | 0064042 | A1 | 3/1982 |
| EP | 0158391 | A1 | 10/1985 |
| EP | 0158391 | B1 | 10/1985 |
| EP | 0288822 | | 11/1988 |
| EP | 0695108 | A2 | 1/1996 |
| EP | 1054573 | B1 | 11/2000 |
| FR | 2058156 | A1 | 5/1971 |
| GB | 792742 | | 4/1958 |
| JP | 62151100 | | 7/1987 |
| WO | WO9213430 | | 8/1992 |
| WO | WO9907182 | | 2/1999 |
| WO | WO0001196 | | 1/2000 |
| WO | WO001199 | | 1/2000 |
| WO | WO0042817 | | 7/2000 |
| WO | WO03015463 | A3 | 2/2003 |
| WO | WO2004025990 | | 3/2004 |

OTHER PUBLICATIONS

European Search Report—European Application 04708638.4-2002 (5 pg.).

Horakustik Publication Dec. 2002, Bruckhoff & Partner GmbH, Hannover, 4 pages.

English Translation of Portions of the Horakustik Publication, 1 page Dec. 2002.

Court Docket for Civil Docket Case No. 4:07-cv-00212-CVE-SAJ, *Hear-Wear Technologies, LLC* v. *Oticon, Inc., et al*., 31 pages, date filed Apr. 16, 2007.

Complaint for Civil Docket Case No. 4:07-cv-00212-CVE-SAJ, *Hear-Wear Technologies, LLC* v. *Oticon, Inc., et al*., 8 pages, date filed Apr. 16, 2007.

Answer and Counterclaim for Civil Docket Case No. 4:07-cv-00212-CVE-SAJ, *Hear-Wear Technologies, LLC* v. *Oticon, Inc., et al*., 11 pages, date filed Jul. 30, 2007.

Corporate Disclosure Statement for Civil Docket Case No. 4:07-cv-00212-CVE-SAJ, *Hear-Wear Technologies, LLC* v. *Oticon, Inc., et al*., 5 pages, date filed Jul. 30, 2007.

Answer with Jury Demand for Civil Docket Case No. 4:07-cv-00212-CVE-SAJ, *Hear-Wear Technologies, LLC* v. *Oticon, Inc., et al*., 3 pages, date filed Aug. 9, 2007.

Markman Expert Designation for Civil Docket Case No. 4:07-cv-00212-CVE-SAJ, *Hear-Wear Technologies, LLC* v. *Oticon, Inc., et al*., 3 pages, date filed Jan. 15, 2008.

Rebuttal Markman Expert Designation for Civil Docket Case No. 4:07-cv-00212-CVE-SAJ, *Hear-Wear Technologies, LLC* v. *Oticon, Inc., et al*., 3 pages, date filed Feb. 15, 2008.

Joint Claim Construction Statement for Civil Docket Case No. 4:07-cv-00212-CVE-SAJ, *Hear-Wear Technologies, LLC* v. *Oticon, Inc., et al*., 15 pages, date filed Apr. 1, 2008.

Phonak Hearing Systems, EduLink—The Direct Link Between Teacher and Student; p. 1-12, Apr. 2003.

*Hear-Wear Technologies, LLC f/k/a Hear-Wear, LLC* v. *Dr. Natan Bayman, Nova Hearing Systems, LLC; and Hearing, Balance and Speech Center, Inc*.; Complaint and Request for Injunctive Relief; Summonses, Civil Cover Sheet; Appearance of L. Page Heslin for Plaintiff; Order on Pretrial Deadlines, dated Sep. 18, 2003; Notice of Dismissal Without Prejudice; In the United States District Court for the District of Connecticut; Civil Action No. 303cv01599 AWT, dated Nov. 12, 2003.

Knowles Electronics Product Catalog—Standard Receivers [online] Dec. 2006, [retrieved on Dec. 5, 2006] Retrieved from the Knowles Electronics website <URL:http//www.knowleselectronics.com/products/technology.asp?CATEGORY_ID=2&TECHNOLOGY_ID=5>.
Office Action issued by the Patent Office of the Russian Federation; Application No. 2005127574/28(030952); Filing Date: Oct. 17, 2006; Applicant(s): Vaivatone Hearing Systems, LLC, Dated Feb. 8, 2008.
Hearing Aid Sales Up a Little in '99, The Hearing Journal Mar. 2000 [online], [retrieved on Dec. 6, 2006], Retrieved from Find Articles website<URL:http://www.findarticles.com/p/articles/mi_hb3496/is_200003/ai_n289085>.
Kirkwood, David H., Hearing aid sales slip back to norm, but leaders see growth potential, The Hearing Journal Dec. 2005 [online], [retrieved on Dec. 6, 2006], Retrieved from the Hearing Journal website <URL:http://www.audiologyonline.com/theHearingJournal/pdfs/HJ2005_12pg11-20.pdf.
Phonak Hearing Systems Media Release UHA 2003, "Phonak know-how address Auditory Processing Disorders," Switzerland, p. 1-2.
Phonak Hearing Systems; Field Study News; "EduLink: Improves Speech Understanding in Noisy Classrooms;" May 2004, p. 1-2.
Phonak Hearing Systems; The Hearing Journal, Jul. 2004, vol. 57, No. 7, p. 45.
International Search Report for International Application No. PCT/US04/03449 filed Feb. 5, 2004.
Re-exam Application No. 95/001,104; filed Nov. 6, 2008.
Shepherd, N.L., Heading to the Beginning, Hearing Products Report Jul. 2006 [online], [retrieved on Dec. 5, 2006] Retrieved from Hearing Products Report website <URL:http://www.hearingproductsreport.com/article.php?s=HPR/2006/07&p=3>.
GN Magazine Jan. 2005 [online], [retrieved on Dec. 7, 2006] Retrieved from GN websiite <URL:http://www.gn.com/var/gn.storage/original/application/ea22f38e4dbfc9fcb0e3cc77e0d7088d.pdf.>.
ReSoundAiR presentation notes/pamphlet (in Danish) Sep. 8, 2003 [pnline], [retrieved on Dec. 6, 2006], Retrieved from GN website <URL:http//www.gn.com/vari/gn/storage/original/application/phpG5vgnN.pdf>.
An Innovative Non-Occluding DSP Device, GN ReSound article created Apr. 2003 [online], [retrieved on Dec. 6, 2006], Retrieved from GN ReSound website <URL:http://www.openfitting.com/2903-gb-03.02.pdf>.
International Search Report for International Application No. PCT/US03/39960 filed Dec. 16, 2003.
"Lend An Ear," Interview with Natan Bauman by Abram Katz, New Haven Register, Oct. 5, 2003, cited during reexamination serial No. 95/001,104.
Sandlin, Robert E., Ph.D., "Textbook of Hearing Aid Amplification," Second Edition, Singular Publishing Group, Thompson Learing, copyright 2000, cited during reexamination serial No. 95/001,104.
Bruckhoff-apparatebau.com; web page downloaded from Internet Archives, Feb. 6, 2003, cited during reexamination serial No. 95/001,104.
Knowles Receivers Internet published Web pages, circa Jun. 2002, cited during reexamination serial No. 95/001,104.
U.S. Appl. No. 10/325,529 Decision on Appeal dated Feb. 27, 2009.
U.S. Appl. No. 95/001,104 Order Granting Request for Inter Partes Reexamination of U.S. Patent No. 7,421,086 dated Jan. 27, 2009.
U.S. Appl. No. 95/001,104 Office Action in Inter Partes Reexamination dated Mar. 19, 2009.
Markku Toivonen, et al., Noise Attenuation and Proper Insertion of Earplugs into Ear Canals, Ann. occup. Hyg., vol. 46, No. 6, pp. 527-530, 2002, 4 pages.
Morgan, N.B., et al., "Taking the art out of smart—Forming processes and durability issues for the application of NiTi shape memory alloys in medical devices," Proceedings from the Materials and Processes for Medical Devices Conference, Sep. 8-10, 2003, Anaheim, CA, 6 pages.
Nova hearing aid, Interview by Medical Reporter Jocelyn Maminta with Natan Bauman, appeared on WTNH-TV Channel 8 on Jun. 30, 2003 (retrieved from "http://www.hearingbalance.com/uploads/Nova.WMV" on Jul. 29, 2009.
"Introducing the Nova" Dr. Natan Bauman, The Hearing Balance & Speech Center (www.hearingbalance.com), Jul. 1, 2003 (retrieved from: http://web.archive.org/web/20030701041351/http://www.hearingbalance.com on Aug. 7, 2009).
Wikipedia, "Nickel Titanium" Jun. 10, 2009, [cited Jul. 29, 2009] available from: [http://en.wikipedia.org/wiki/Nickel_titanium].
Wikipedia, "Shape memory alloy" Jun. 28, 2009, [cited Jul. 29, 2009] available from: [http://en.wikipedia.org/wiki/Shape_memory_alloy].
Carsten, Daugaard, Delta "Insertion loss and occlusion effect measured on open fit hearing aid" Technical Note, Oct. 21, 2008.
Affidavit of Henning Bruckhoff dated Nov. 27, 2008.
Affidavit and Declaration of Doug Erickson dated Sep. 29, 2008 and Jul. 25, 2008.
Notice of Opposition Documents_047086384/1590988, filed Aug. 2009.
Partial Translation of Appeal Brief filed on Jan. 13, 2009, JP4006470B.
Notification of First Office Action dated May 8, 2009, 2004800055634 China.
Reexam 95001104_Requester Comments and Thompson Declaration filed Jan. 6, 2010.
Chinese Patent Application No. 200480005563.4 Office Action dated Mar. 30, 2011, 4 pages.
Chinese Patent Application No. 200480005563.4 Office Action dated Jul. 28, 2011, 4 pages.
95000596_Reexam Opposition filed in Response to Petition dated Mar. 21, 2011, 14 pages.
95000596_Reexam_NonFinal Action dated May 23, 2011, 63 pages.
95000612_Reexam_NonFinal Action dated Jun. 15, 2011, 46 pages.
95000596_Reexam_Owner Response after NonFinal Action dated Jul. 25, 2011, 45 pages.
95001104_Reexam_Owner Appeal Brief dated Jul. 25, 2011, 73 pages.
95001104_Reexam_Third Party Requester Appeal Brief dated Aug. 5, 2011, 23 pages.
95000612_Reexam_Owner Response after NonFinal Action dated Aug. 15, 2011, 43 pages.
95000596_Reexam_Third Party Requester Comments after NonFinal Action dated Aug. 23, 2011, 30 pages.
95001104_Reexam_Owner Respondent Brief dated Sep. 1, 2011, 15 pages.
95000612_Reexam_Third Party Requester Comments after NonFinal Action dated Sep. 14, 2011, 34 pages.
95001104_Reexam_Examiner's Answer to Appeal Brief dated Sep. 30, 2011, 6 pages.
95001104_Reexam_Requester Respondent Brief dated Sep. 30, 2011, 21 pages.
95001104_Reexam_Owner Rebuttal Brief dated Oct. 31, 2011, 48 pages.
95001104_Reexam_Requester Rebuttal Brief dated Oct. 31, 2011, 7 pages.
Complaint for Patent Infringement filed by Patent Owner: *Auditory Licensing Company, LLC* vs. *GN Resound A/S, et al.*, filed by Patent Owner on Jul. 6, 2010, in the U.S. District Court for the District of Connecticut, Civil Action No. 3:10-CV-1054.
Declaratory Judgement action: *GN Resound A/S, et al.* vs. *Auditory Licensing Co., LLC*, filed on Jul. 6, 2010 in the U.S. District Court for the District of Connecticut, Civil Action No. 3:10-CV-1052.
English Translation of Trial Examiner's Opinion dated Sep. 17, 2010_JP4006470, 12 pages.
Reexam_95001104_PTO Action Closing Prosecution dated Oct. 1, 2010.
Reexam_95001104_Amendment filed Nov. 1, 2010.
Reexam_95001104_Requester's Comments filed Dec. 1, 2010.
Reexam Application No. 95000596 filed Nov. 19, 2010.
Reexam Application No. 95000612 filed Jan. 10, 2011.
Reexam_95000596_Order Granting Request for Inter Parties Reexam dated Feb. 7, 2011.
Reexam_95000596_Petition to Vacate an Ultra Vires Reexam Order Under 37 CFR 1.181 filed Mar. 7, 2011.

Reexamination Control No. 95/001,104, Mar. 14, 2013 Transcript of Oral Hearing, 43 pages.
Complaint for Patent Infringement filed by Patent Owner: *Vivatone Hearing Systems, LLC* vs. *GN Resound A/S, et al.*, filed by the Patent Owner on Sep. 2, 2008, in the U.S. District Court for the Eastern District of Texas, Marshall Division, Civil Action No. 2-08CV-334.
U.S. Appl. No. 10/325,529, filed Dec. 18, 2002, including submitted evidence of secondary consideration, such as the submitted evidence of Vivatone commercial sales success from 2004-2006, evidence of copying by competitors, and long felt need, as well as the related expert declarations.
U.S. Appl. No. 10/773,731, filed Feb. 5, 2004, including submitted evidence of secondary consideration, such as the submitted evidence of Vivatone commercial sales success from 2004-2006, evidence of copying by competitors, and long felt need, as well as the related expert declarations.
Effect of Ear Canal Occlusion on Pure-Tone Threshold Sensitivity, J. Am Acac Audio 16:740-746 (2005).
Hearing Aid Handbook, pp. 186-195, TAB Books (1978).
A Comprehensive Dictionary, definition of "Non-Occluding Mold" The Hearing Aid Journal (1973).
Ballachanda, Bopanna B., The Human Ear Canal, 1995, Dingular Publishing Group, Inc. 1st Ed., p. 126.
First Amended Complaint dated Mar. 3, 2009, Civil Action No. 2-08CV-334.
Phonak Answer dated Mar. 23, 2009, Civil Action No. 2-08CV-334.
Sonas et al. Answer dated Mar. 23, 2009, Civil Action No. 2-08CV-334.
Unitron Hearing Answer to First Amended Complaint dated Mar. 23, 2009, Civil Action No. 2-08CV-334.
Oticon Bernafon Answer Affirmative Defs dated Mar. 23, 2009, Civil Action No. 2-08CV-334.
Answer to Amended Complaint by GN Resound dated Mar. 23, 2009, Civil Action No. 2-08CV-334.
Answer to Amended Complaint by Siemens Hearing Instruments dated Mar. 23, 2009, Civil Action No. 2-08CV-334.
Defendant Sebotek Hearings Answer to First Amended Complaint dated Mar. 30, 2008, Civil Action No. 2-08CV-334.
Vivatone's Response to GN Defs Answer dated Apr. 13, 2009, Civil Action No. 2-08CV-334.
Vivatone's Answer to Oction and Bernafons Counterclaims dated Apr. 13, 2009, Civil Action No. 2-08CV-334.
Vivatone's Answer to Unitron Hearing Counterclaims dated Apr. 13, 2009, Civil Action No. 2-08CV-334.
Vivatone's Answer to Phonak Counterclaims dated Apr. 13, 2009, Civil Action No. 2-08CV-334.
Vivatone's Answer to Siemens Counterclaims dated Apr. 13, 2009, Civil Action No. 2-08CV-334.
Vivatone's Answer to Sebotek Counterclaims dated Apr. 13, 2009, Civil Action No. 2-08CV-334.
Vivatone's Answer to Sonus and Amplifon Counterclaims dated Apr. 13, 2009, Civil Action No. 2-08CV-334.
Answer of Widex to First Amended Complaint dated Oct. 1, 2009, Civil Action No. 2-08CV-334.
Vivatone's Answer to Widex Counterclaims dated Oct. 5, 2009, Civil Action No. 2-08CV-334.
95001104 Reexam—Requester Comments filed Apr. 26, 2010.
EP04708638.4—Response to Opposition filed Apr. 6, 2010.
95001104 Reexam—Amendment filed May 4, 2010.
95001104 Reexam—Requester Comments filed Jun. 3, 2010.

* cited by examiner

OPEN EAR HEARING AID SYSTEM

CROSS REFERENCE TO RELATED APPLICATIONS

The present application is a continuation of and claims priority to U.S. patent application Ser. No. 10/325,529, filed Dec. 18, 2002 now U.S. Pat. No. 7,751,580, U.S. patent application Ser. No. 10/241,279, filed Sep. 10, 2002 now U.S. Pat. No. 7,076,076, U.S. Provisional Patent Application No. 60/445,034, filed Feb. 5, 2003, U.S. Provisional Patent Application No. 60/514,994, filed Oct. 27, 2003, U.S. patent application Ser. No. 10/773,731, filed Feb. 5, 2004 now abandoned, U.S. Provisional Patent Application No. 60/535,569, filed Jan. 9, 2004, U.S. patent application Ser. No. 11/331,842, filed Jan. 13, 2006 now U.S. Pat. No. 7,421,086, and U.S. patent application Ser. No. 12/170,574 filed Jul. 10, 2008, the entire contents of each of which are specifically incorporated herein by reference.

BACKGROUND OF THE INVENTION

The present invention relates to a hearing aid system and in particular to a receiver system used in the hearing aid system.

A wide variety of hearing aid units are known in the art. In some units, the receiver is positioned within the ear canal in such a way that it creates an occlusion effect. Further, the receiver is encased within the body of the hearing aid. In most cases whether the hearing aid is fitted in the ear, as a custom made instrument, or as an instrument which is placed behind the ear, an occlusion problem exists. This often is a cause of rejection of the amplification due to patient's discomfort with their own voice. This occlusion effect is associated with the sensation of feeling that the patient's head is "at the bottom of the barrel" with the patient's own voice becoming intolerably loud. Placing an earmold or a shell of a custom made hearing aid can produce an additional low frequency amplification of the patient's own voice up to 20 to 30 dB. This can, therefore, be responsible for a four times perceived loudness increase in the patient's own voice. In order to eliminate the occlusion effect, an open ear canal amplification is applied. However, the acoustics of an open ear fitting increase the risk of acoustic feedback prohibiting in most instances to achieve a peak gain of more than 30 dB.

Thus, there is a need for an improved hearing aid system which avoids the occlusion effect and which also avoids feedback, especially during high frequency amplification.

SUMMARY OF THE INVENTION

Accordingly, it is an object of the present invention to provide a receiver, receiver placement, and a receiver casing which avoids the occlusion effect.

It is a further object of the present invention to provide a receiver system which helps avoid feedback during high frequency amplification.

It is a further object of the present invention to provide a hearing aid system having a receiver, such as the aforementioned receiver, separated from the microphone.

The foregoing objects are attained by the receiver and the hearing aid system of the present invention.

In accordance with the present invention, a receiver and a receiver casing for use in a system for improving a user's hearing, in a hearing aid system is provided. Also, it is the intention to use same receiver system removed from the body of the instrument to be used in a tinnitus device as described in U.S. Pat. No. 6,048,305. It is essential to have an open ear tinnitus instrument in the tinnitus retraining therapy program. Therefore, this present invention will provide such by having the body of the instrumentation placed behind the ear with the receiver placed in the ear canal without obstructing the external auditory means.

In a first embodiment, the receiver comprises a housing to be positioned within an ear canal and a plurality of arms extending from the housing. The tip portion of each arm contacts a surface of a user's ear canal and suspends the receiver within the ear canal.

In a second embodiment, the receiver is housed in a disc. The disc is formed from a frequency specific filtering material. The disc has an adjustable rim which when placed in the ear canal uses spring like motion to maintain receiver position.

Further, in accordance with the present invention, a hearing aid system is provided. The hearing aid system comprises a microphone located externally of a user's ear canal, an amplifier connected to the microphone to amplify sounds received by the microphone, a receiver positioned within the user's ear canal, and means for transmitting the amplified output to the receiver. As before, the receiver preferably has a housing and a plurality of arms extending from the housing for suspending the receiver within the user's ear canal. Alternatively, the receiver may be housed within a disc structure.

Other details of the hearing aid system of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
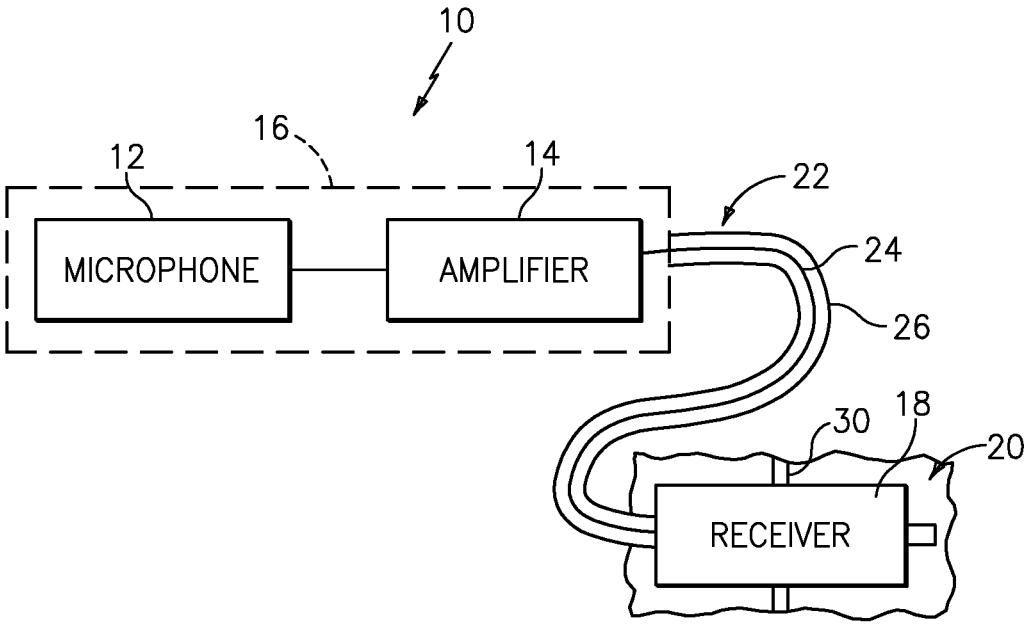
FIG. 1 is a schematic representation of a hearing aid system.

Referring now to the drawings, FIG. 1 illustrates a hearing aid system 10 in accordance with one aspect of the present invention. The hearing aid system 10 includes a microphone 12 and an amplifier 14. The microphone 12 and the amplifier 14 are positioned within a housing 16. The housing 16 may form part of a behind—the—ear unit, part of a unit installed within a user's eyeglass frame, or part of a unit installed within a headset. The hearing aid system 10 may further include a battery (not shown) and means for controlling the hearing aid such as a volume control.

The hearing aid system 10 further includes a receiver 18 which is separated from the housing containing the microphone. The receiver is installed and suspended within the ear canal 20 of a user and means 22 for transmitting amplified output from the amplifier 14 to the receiver 18. The sound transmitting means 22, depending upon the particular kind of amplifier 14 being used, may be a wire 24 encased within a plastic coating 26 housing the wire. When used, the wire 24 makes an electrical contact with the amplifier 14 and the receiver 18 over which electrical output can be transmitted. The plastic coating around the wire 24 helps prevent electrical shocks.

Figure 6:
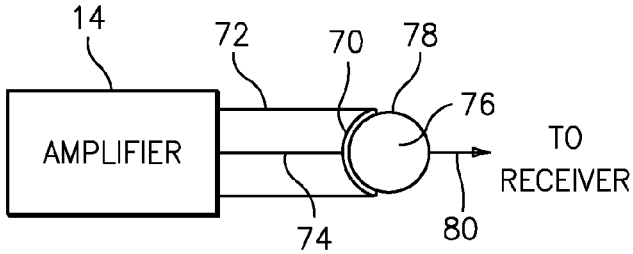
FIG. 6 illustrates a system for connecting the output of an amplifier to a receiver.

An alternative way of connecting the output from the amplifier 14 to the receiver 18 is shown in FIG. 6. In this approach, there is an arcuately shaped electric contact 70 attached to the amplifier 14 by supports 72. A wire 74 extends between amplifier 14 and the contact 70. The electrical contact 70 is shaped in the manner of a ball socket to receive a ball 76. The ball 76 has an electrical coating on its outer surface 78 and a wire 80 which attaches to the receiver 18.

The microphone 12, the amplifier 14, and the control means may comprise any suitable microphone, amplifier, and control means known in the art. Similarly, the receiver 18 may comprise any suitable receiver known in the art.

Figure 2:
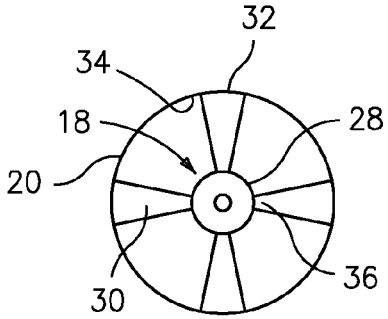
FIG. 2 is a front view of a suspended receiver used in the hearing aid system of FIG. 1.
Figure 3:
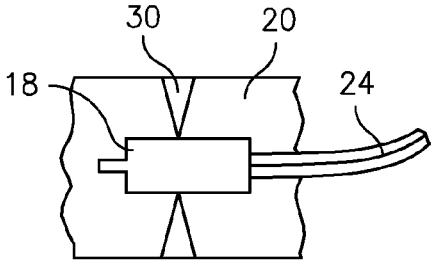
FIG. 3 is a side view of the receiver of FIG. 2 positioned within a user's ear canal.

As shown in FIGS. 2 and 3, the receiver 18 has a housing 28. To position and suspend the receiver 18 within the ear canal 20, a plurality of arms 30 extend from the housing 28. Each of the arms 30 is formed from a flexible material such as a flexible plastic material. The tip portions 32 of each arm 30 contact a surface 34 of the ear canal 20 to position the receiver 18 in a desired location in the ear canal 20. As can be seen from FIG. 2, each arm 30 tapers from the tip portion 32 to a base portion 36. In a preferred embodiment of the present invention, the arms 30 are spaced 90 degrees from each other.

The arms 30 are quite advantageous because they allow the receiver 18 to be positioned or suspended in such a way that the receiver 18 does not occlude the ear canal. Further, the arms 30 allow the use of any size of receiver in the hearing aid systems. Still further, the receiver, separated from the microphone, provides a greater flexibility in delivering high frequency amplification without causing or creating feedback. Thus, protection of the ear canal and the separation of the receiver 18 from the microphone 12 allows one to achieve greater high frequency gain without feedback.

Further, a suspended receiver away from the ear canal walls will also provide a better protection from impacting the receiver with cerumen.

While it has been stated that the microphone 12 and the amplifier 14 are in the same housing, it should be noted that they could be in separate housings depending upon the type of hearing aid system 10. For example, if the system 10 is incorporated in an eyeglass frame, the microphone could be in one part of the frame and the amplifier could be in another part of the frame.

Figure 4:
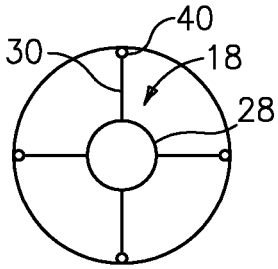
FIG. 4 illustrates an alternative embodiment of a suspended receiver in accordance with the present invention.

While it is preferred to form the arms 30 from a flexible plastic material, each of the arms 30 could also be formed from a bendable wire. When formed from a bendable wire, as shown in FIG. 4, each wire may have a plastic or metal ball 40 at the end which makes contact with a surface of the user's ear canal.

If desired, the length of the insertion of the receiver 18 in the ear canal 20 can be adjusted using a retractable wire 24 from the sound transmitting means 22 or by replacing the ear hook on a behind the ear hearing aid unit.

Figure 5:
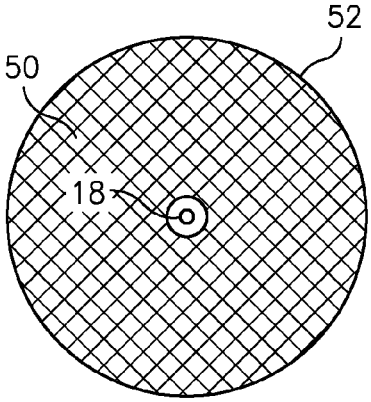
FIG. 5 illustrates an embodiment of a receiver housed in a disc.

Referring now to FIG. 5, an alternative receiver embodiment is illustrated. The receiver 18 is housed within a disc 50 of exchangeable sound filtration material. The material forming the disc 50 may be formed from a paper or fabric like material which is transparent to most sound except sound which is to be filtered out. By making the disc 50 exchangeable or replaceable, one can mechanically change the frequency response of sounds that are escaping out of the hearing aid. One can also filter out any frequency that causes feedback. The disc 50 is preferably formed with a rim 52 that flexes, such as a rim formed from a spring—like material, in order to maintain the position of the receiver 18 and disc 50 in a desired position in the ear canal.

Figure 7:
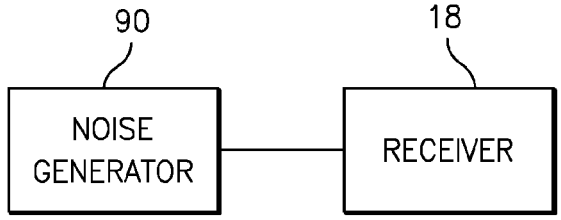
FIG. 7 is a schematic representation of a tinnitus/hyperacusis treatment system.

While the receiver 18 of the present invention has been described in the context of hearing aid systems, the receiver could also be used in tinnitus treatment systems. For example, as shown in FIG. 7, a noise generator 90 may be positioned behind the wearer's ear in lieu of the microphone or amplifier and attached to a receiver 18 positioned within the user's ear canal. The noise generator 90 generates sounds to be transmitted to the tympanic membrane for the treatment of tinnitus/hyperacusis. The receiver 18 may have a disc 50 surrounding it or a plurality of arms 30 radiating from it in order to position it within the ear canal. The disc 50 and the arms 30 may have the structure described hereinbefore.

While the receiver 18, when used in either the context of a hearing aid system or a tinnitus treatment system, has been described as being connected to an amplifier 14 or a noise generator 90 by a wire, it should be recognized that the receiver 18 could be disconnectable so that it can be separated from the body of the instrument to which it is connected. Any suitable means known in the art may be used to render the receiver 18 disconnectable.

Figure 8:
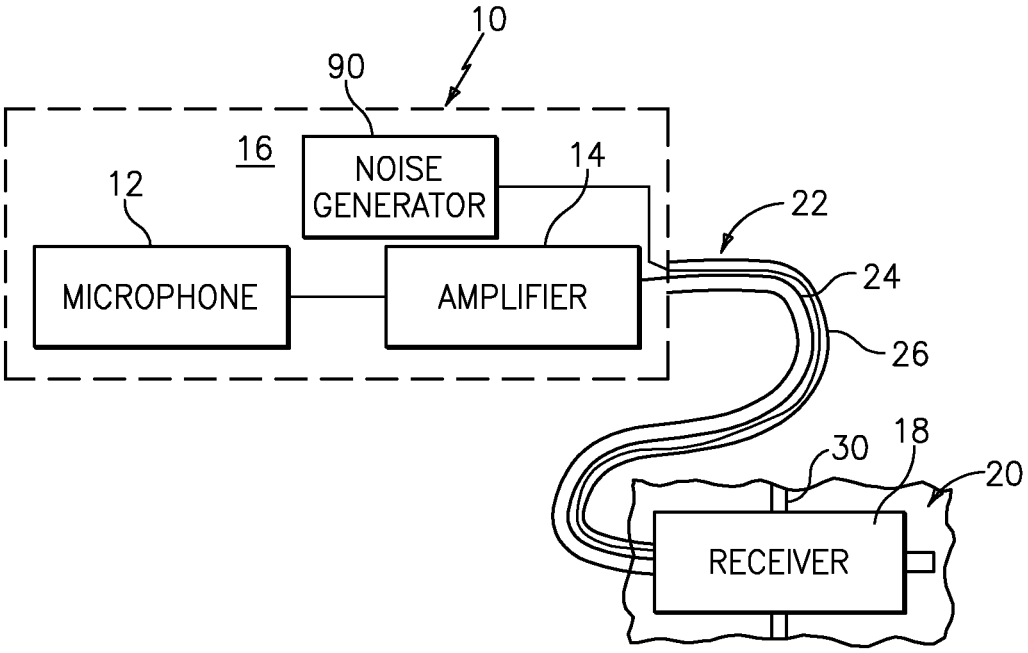
FIG. 8 is a schematic representation of a hearing aid which includes a tinnitus/hyperacusis treatment system.

In yet another embodiment of the present invention as shown in FIG. 8, the hearing aid system 10 may have an amplifier 14 and a noise generator 90 located within a housing 16. Additionally, the housing 16 may include a microphone 12, although the microphone 12 could be separate from the housing 16 if desired. The amplifier 14 and the noise generator 90 are each connected to a receiver 18 positioned within the user's ear canal in such a way that the receiver 18 does not occlude the ear canal. The amplifier 14 and the noise generator 90 may be connected to the receiver 18 using any suitable means known in the art including, but not limited to, the connection means shown in FIG. 6. If desired, both the amplifier 14 and the noise generator 90 may be disconnectable from the receiver 18. The amplifier 14 may comprise any suitable programmable digital amplifier known in the art. The noise generator 90 is preferably a programmable digital noise generator which may be used to generate sounds to be transmitted to the tympanic membrane for the treatment of tinnitus/hyperacusis.

The hearing aid system shown in FIG. 8 provides numerous advantages. The most significant of these advantages is that a user can be provided with both a hearing aid and a noise generator for combating tinnitus/hyperacusis in a single unit. Another advantage is that both the amplifier and the noise generator may be located in a unit which can be placed behind the user's ear.

It is apparent that there has been provided in accordance with the present invention a hearing aid system which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A hearing aid system, comprising:

a receiver comprising a housing to be positioned in an open ear configuration within an ear canal, said housing comprising a speaker and having an arm extending from said housing, and a portion of said arm contacting said ear canal to suspend the receiver in the ear canal and away from the ear canal walls to effect said open ear configuration; and a microphone sampling position, said sampling position located remote from the ear canal and the speaker positioned therein, wherein sound from the microphone sampling position is amplified in accordance with hearing loss programming and passed via electrical connection around a portion of the external ear and through the ear canal opening to the speaker that is positioned within the ear canal in an open ear configuration for delivery of audible sound to the unoccluded ear canal, wherein said microphone sampling position and an amplifier are positioned within a behind the ear unit.

2. A hearing aid system according to claim 1, further comprising means for transmitting amplified sound connected to said housing.

3. A hearing aid system according to claim 2, wherein said amplified sound transmitting means comprises a wire coated with a plastic material connected to said receiver.

4. A hearing aid system according to claim 1, wherein said receiver is disconnectable.

5. A hearing aid system according to claim 1, wherein said housing includes a plurality of arms generally spaced an equal number of degrees apart.

6. A hearing aid system according to claim 1, wherein said arm is formed from a flexible material.

7. A hearing aid system according to claim 1, wherein said arm is formed from a plastic material.

8. A hearing aid system according to claim 1, wherein said arm is formed from a bendable wire.

9. A hearing aid system according to claim 1, wherein said arm has a base portion and tapers from said tip portion to said base portion.

10. A hearing aid system comprising a microphone sampling position located externally of an ear canal of a user, a receiver comprising a speaker positioned in an open ear configuration and suspended within said ear canal and away from the ear canal walls to effect said open ear configuration, wherein sound from the microphone sampling position is amplified in accordance with hearing loss programming and passed via electrical connection around a portion of the external ear and through the ear canal opening to the speaker that is positioned within the ear canal in an open ear configuration for delivery of audible sound to the unoccluded ear canal, wherein said microphone sampling position and an amplifier are positioned within a behind the ear unit.

11. A hearing aid system according to claim 10, wherein said receiver has a housing and a plurality of arms extending from said housing, said arms contacting said user ear canal to position said receiver within said ear canal.

12. A hearing aid system according to claim 10, wherein said amplified sound transmitting means comprises an electrical contact connected to said amplifier and a ball with an electrical coating attached to said receiver and contacting said electrical contact.

13. A hearing aid system according to claim 10, wherein said receiver is disconnectable.

14. A hearing aid system according to claim 11, wherein each of said arms has a base portion and a tip portion and each of said arms tapers from said tip portion to said base portion.

15. A hearing aid system according to claim 11, wherein said plurality of arms comprises four arms spaced about the periphery of said housing.

16. A hearing aid system according to claim 15, wherein each of said four arms is spaced from an adjacent arm by an angle of ninety degrees.

17. A hearing aid system according to claim 11, wherein each of said arms is formed from a flexible material.

18. A hearing aid system according to claim 11, wherein each of said arms is formed from a plastic material.

19. A hearing aid system according to claim 11, wherein each of said arms is formed from a bendable wire.

20. A hearing aid system according to claim 19, wherein each said wire has a ball at an end making contact with a surface of the user's ear canal.

21. A hearing aid system according to claim 10, wherein said receiver is housed within a disc positioned within the user's ear canal.

22. A hearing aid system according to claim 21, wherein the disc is formed from a sound filtering material.

23. A hearing aid system according to claim 21, wherein the disc has a rim formed from a flexible material.

24. A hearing aid system according to claim 21, wherein the disc is replaceable.

25. A hearing aid system comprising a microphone sampling position located externally of an ear canal of a user, a receiver comprising a speaker positioned in an open ear configuration within said ear canal, said speaker including a plurality of flexible, spaced arms extending radially from said speaker such that said arms suspend said speaker in the ear canal and away from the ear canal walls to effect said open ear configuration, wherein sound from the microphone sampling position is amplified in accordance with hearing loss programming and passed via electrical connection around a portion of the external ear and through the ear canal opening to the speaker that is suspended within the ear canal in an open ear configuration for delivery of audible sound to the unoccluded ear canal, and wherein said electrical connection passed around a portion of the external ear and through the ear canal opening to the speaker comprises a coated wire wherein said microphone sampling position and an amplifier are positioned within a behind the ear unit.

26. A hearing aid system in accordance with claim 25, wherein said wire comprises a plastic coated wire.

27. A hearing aid system according to claim 25, wherein said receiver is disconnectable.

28. A hearing aid system according to claim 25, wherein said arms have a base portion and a tip portion and said arms taper from said tip portion to said base portion.

29. A hearing aid system according to claim 25, wherein each of said arms is spaced from an adjacent arm by an angle of ninety degrees.

30. A hearing aid system according to claim 25, wherein said arm is formed from a plastic material.

31. A hearing aid system according to claim 25, wherein said arm is formed from a bendable wire.

32. A hearing aid system according to claim 31, wherein said wire has a ball at an end.

33. A hearing aid system according to claim 10, wherein said electrical connection passed around a portion of the external ear and through the ear canal opening to the speaker comprises a wire.

34. A hearing aid system in accordance with claim 33, wherein said wire comprises a coated wire.

35. A hearing aid system according to claim 10, wherein said receiver has a housing and an arm extending from said housing, said arm suspending said receiver within said ear canal.

36. A hearing aid according to claim 25, wherein said plurality of arms are equally spaced about the periphery of said speaker.

37. A hearing aid according to claim 25, wherein said plurality of arms include at least three arms.

38. A hearing aid system according to claim 25, wherein said receiver is housed within a disc positioned within the user's ear canal.

39. A hearing aid system according to claim 33, wherein said wire comprises a plastic coated wire.

40. A hearing aid system according to claim 38, wherein the disc is replaceable.

* * * * *